United States Patent [19]
Galer
[11] 4,212,410
[45] Jul. 15, 1980

[54] GRAVITY DUMP SHIPPING CRATE FOR POULTRY

[75] Inventor: Herbert W. Galer, Newnan Boro, Ga.

[73] Assignee: United States Steel Corporation, Pittsburgh, Pa.

[21] Appl. No.: 47,414

[22] Filed: Jun. 11, 1979

[51] Int. Cl.² ..... B65D 45/16
[52] U.S. Cl. ..... 220/324; 217/57; 119/19
[58] Field of Search ..... 220/324, 326, 315, 334, 220/4 B; 217/57, 36; 119/19

[56] References Cited

U.S. PATENT DOCUMENTS

| | | | |
|---|---|---|---|
| 3,330,434 | 7/1967 | Bromley | 220/334 |
| 3,632,007 | 1/1972 | Kantor | 217/57 |
| 3,754,676 | 8/1973 | Box | 220/324 |
| 3,930,467 | 1/1976 | Fier, Jr. | 119/19 |
| 3,966,084 | 6/1976 | Box | 220/326 |

*Primary Examiner*—George T. Hall
*Attorney, Agent, or Firm*—William A. Danchuk

[57] ABSTRACT

A gravity-operated latch permits a secure closure for a cover on a loaded poultry shipping crate. The latch flips open, permitting the cover to open, in a sequence coinciding with the sequence of efficient orientation of the crate as the crate is turned and dumped. At the conclusion of the full 360° dumping operation, the latch is relocked and the crate is ready for reshipment.

4 Claims, 5 Drawing Figures

GRAVITY DUMP SHIPPING CRATE FOR POULTRY

BACKGROUND OF THE INVENTION

The growth of the poultry industry in recent years has led to the development of numerous improvements in the handling and transporting of large numbers of live poultry. Such improvements include notably the development of injection molded plastic shipping crates or coops. The molded crates have been found to be less expensive, more durable, stronger, and more amenable to stacking than other shipping crates of more conventional materials and design. Poultry crates are notoriously abused by the vagarious inflictions of the road and the elements when carried on flat-bed trucks and by human handlers at the loading and unloading sites. It is important that they remain stacked when stacked and latched when latched, but that they be easily unstacked and dumped as required. The latches in particular should be designed to minimize the damage of rough treatment.

As an example of a prior art molded plastic poultry container, the reader may be interested in Bromley's U.S. Pat. No. 3,330,434. This design includes a nesting configuration and a latch and door opening which must be operated manually and independently.

Shreckhise's U.S. Pat. No. 3,993,026 describes a "self-dumping" door in addition to a loading door and employing a spring-loaded latching means. Having a number of moving parts, the latch is susceptible to various types of failures. Box, in U.S. Pat. No. 3,966,084, recognizes the problem inherent in prior art latches, and provides a sliding configuration which, however, can be opened accidentally.

SUMMARY OF THE INVENTION

My invention overcomes many of the problems of prior poultry shipping crates in that it provides a latch which employs no springs or moving parts other than the latch itself, is simple and easily operable, and whose action in opening the door of the crate is coordinated with the natural flow of the movements by which the poultry are dumped.

The latch of the present invention is configured such that the latch in its closed or locked position rests within an indentation in the top of the shipping crate so its upper surface extends no higher than the top of the shipping crate. This configuration permits the abutment of a series of crates and the opening of their doors or tops without requiring the separation of successive crates to effect such opening.

Accordingly, it is a general object and feature of the present invention to provide a readily dumped shipping crate having a hinged cover and a latch therefor, said latch being pivotally mounted to the cover and being positioned within an indentation in the cover when the latch is in its closed or locked position.

Other objects and features of the present invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional objects and advantages thereof will best be understood from the following description of the preferred embodiment of the present invention when read in conjunction with the accompanying drawings wherein:

DETAILED DESCRIPTION OF THE INVENTION

Figure 1:
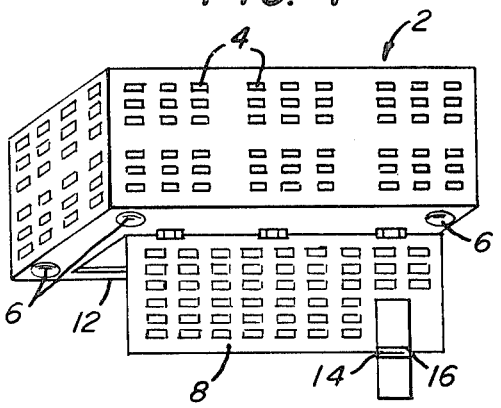
FIG. 1 is a perspective view of the complete crate, from an angle showing the cover of the carte when it is in the dumping position, i.e., inverted and freely hanging.

Referring now to FIG. 1, crate 2 is preferably a plastic, i.e., polyethylene injection molded crate having a plurality of air holes 4, and being generally rectangular in shape. It may have sockets 6 on the under side and complementary projections (not shown) on the upper side as are known in the art (illustratively in U.S. Pat. Nos. 3,966,084 and 3,330,434) so that stacks of the crates will be relatively stable. A cover 8 is mounted on hinges 10. The area which it covers terminates close to the side 12 of the crate farthest from the hinges for latching purposes to be illustrated in the remaining Figures. A latch 14 is mounted on a pin 16 in a manner illustrated in FIGS. 2–5 so that it is freely swingable through approximately 15°. An indentation 18 in the cover 8 is designed to accommodate the covered and latched position of latch 14 without protrusion over the general surface level of the cover 8.

Figure 2:
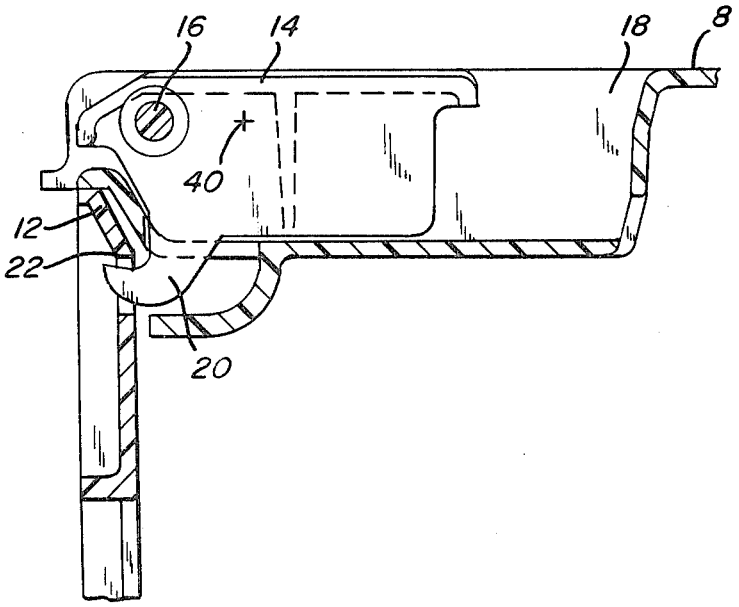
FIG. 2 is a section of the latch portion when the crate is in "normal" position, i.e., the cover is on top and the latch is latched.

In FIG. 2, a sectional view is shown of the latch portion of the invention. Latch 14 is in the latched position. That is, the crate side 12 represents the "front" of the crate, and the indentation 18 is on the top of the crate. The latch 14 has been pivoted on pivot 16 so that its latching projections 20 are close to the latching surface 22 of side 12. Persons skilled in the art will recognize that the center of gravity 40 of latch 14 is, in this view, to the right of pivot 16 and therefore latch 14 rests against indentation 18, so that no springs or other moving or mechanical devices need be utilized to effect a secure closure of cover 8. Pivot 16 is, of course, mounted on cover 8 as will be better understood by reference to FIG. 1.

Figure 3:
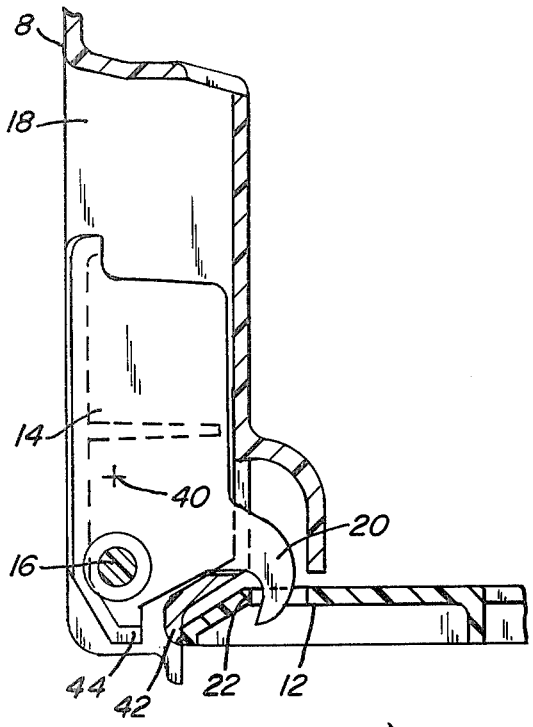
FIG. 3 shows the same section as in FIG. 2 when the crate has been turned 90° in a counterclockwise direction.
Figure 4:
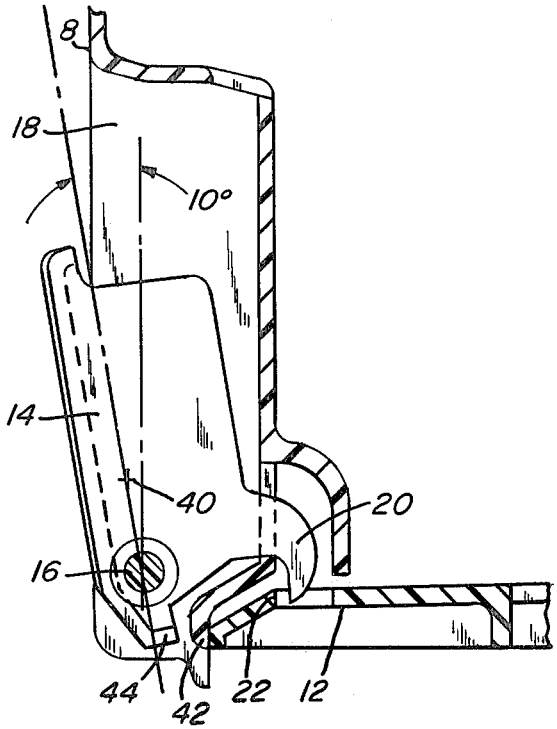
FIG. 4 shows the same section rotated to slightly further from its position shown in FIG. 3, with the latch in its unlatched position.
Figure 5:
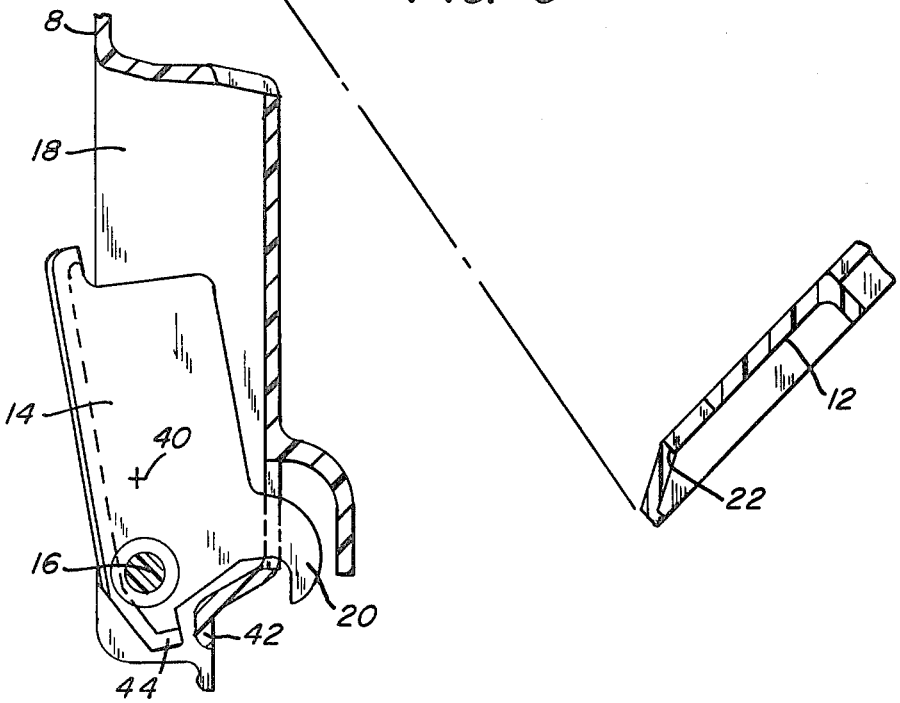
FIG. 5 illustrates the same sectioned portion after the coop has been rotated 45° beyond FIG. 4 with the door now hanging open.

As shown in FIG. 3, the crate 2 has been rotated counterclockwise 90° as occurs at the beginning of a dump. Unlatching does not automatically occur until rotation has progressed past this stage. Specifically, the center of gravity indicated at point 40 lies directly above the pivot point 16. Consequently, there is no impetus for the center of gravity to fall either clockwise or counterclockwise from this point. However, as indicated in FIG. 4, any further rotation in a counterclockwise direction will place the center of gravity 40 to the left of an imaginary vertical line drawn through the pivot point 16 thereby resulting in a counterclockwise rotation of the latch 14 about the pivot 18. Once the status of rotation shown in FIG. 4 has been achieved, the operator need not do anything with the latch; it simply swings open by gravity.

The cover 8, which has no restraints upon it other than the latch 14, begins to pivot about its hinges 10 and hangs freely downward leaving an exit through which the poultry may fall. Latch 14 is designed to be rotatable from its latch position to its unlatch position a total of 15°. At this stage, an interaction between a boss extension 42 and an extension 44 of the cover prevents further counterclockwise rotation. As a result, the latch 14 is not placed in a position in which inadvertent damage may occur. When the crate 2 has been rotated another 90° and rests in an upsidedown position relative to FIG. 2, the cover 8 hangs downward freely for dumping of the poultry. The crate is then automatically rotated another 180° to its originally position as shown in FIG. 2. At this stage, the latch 14 automatically assumes a relatched position for securing the cover 8 to the top of the coop. This automatic relatching prevents any damage to the cover or the latch during restacking or reloading of the crates upon a conveyance vehicle.

In conclusion, it may be seen that there is provided a simple, efficient and fully automatic self-dumping chicken coop. The lack of complicated components and the simplification of moving parts included in the present invention provides for a reliable and easily maintained apparatus which facilitates the automation of poultry loading and unloading.

While certain changes may be made in the above-identified apparatus without departing from the scope of the invention herein involved, it is intended that all matter contained in the above description, or shown in the accompanying drawings shall be interpreted as illustrative and not in a limiting sense.

I claim:

1. A readily dumped shipping crate comprising a container, a hinged cover therefor, and a latching assembly on said hinged cover, said latching assembly being pivotally mounted on the edge of the cover opposite the hinges thereof so that, in the closed position it lies in said cover and making latching engagement with a portion of said container, and in the unlatched position it is suspended from its pivot in a position in which it is rotated out of latching engagement with said portion of said container and extends outwardly from said cover.

2. The crate of claim 1 wherein the latch in the closed position rests in an indentation in the cover so its upper surface is no higher than the surface of the cover.

3. The crate of claim 1 wherein the latch includes a latching projection which, in the latching position is inhibited in upward movement by a latching aperture on the crate with which said latching engagement is established.

4. The crate of claim 1 wherein the center of gravity of said latch is orientated on said latch such that rotation of said crate beyond 90° is necessary to effect the unlatching of the latch and opening of said hinged cover.

* * * * *